US005524417A

United States Patent [19]

Iddon

[11] Patent Number: 5,524,417

[45] Date of Patent: Jun. 11, 1996

[54] ENVELOPE OPENING MECHANISM FOR INSERTER APPARATUS

[75] Inventor: Robert O. Iddon, Broxbourne, England

[73] Assignee: Printed Forms Equipment Limited, Loughton, England

[21] Appl. No.: 295,879

[22] PCT Filed: Mar. 5, 1993

[86] PCT No.: PCT/GB93/00459

§ 371 Date: Nov. 7, 1994

§ 102(e) Date: Nov. 7, 1994

[87] PCT Pub. No.: WO93/17880

PCT Pub. Date: Sep. 16, 1993

[30] Foreign Application Priority Data

Mar. 6, 1992 [GB] United Kingdom ..... 9204944

[51] Int. Cl.[6] ..... B43M 3/04; B65B 43/39

[52] U.S. Cl. ..... 53/381.7; 53/381.5; 53/569

[58] Field of Search ..... 53/381.5, 381.7, 53/381.3, 569, 284.3, 387.2, 468, 460, 206

[56] References Cited

U.S. PATENT DOCUMENTS

| | | | |
|---|---|---|---|
| 1,317,387 | 9/1919 | Penney et al. | 53/381.7 X |
| 1,916,847 | 7/1933 | McCarthy | 53/381.7 X |
| 1,960,959 | 5/1934 | Sague | 53/381.7 X |
| 3,015,926 | 1/1962 | Galambos | 53/381.7 X |
| 3,474,711 | 10/1969 | Swinyar | 53/381.7 X |
| 3,935,800 | 2/1976 | Sette et al. | 53/381.7 X |
| 3,974,749 | 8/1976 | Luperti et al. | 53/381.7 X |
| 4,962,624 | 10/1990 | Foster et al. | 53/381.7 X |
| 5,156,585 | 10/1992 | Dimur et al. | 53/381.7 X |

FOREIGN PATENT DOCUMENTS 0009323 4/1980 European Pat. Off. .

*Primary Examiner*—James F. Coan
*Attorney, Agent, or Firm*—Young & Thompson

[57] ABSTRACT

An envelope opening mechanism for an inserter apparatus comprises post-like abutments (25) against which envelopes (10) are successively fed, with the hinge edge leading, over a guide surface (22) with an inclined portion (24), to initiate envelope flap opening movement by buckling of the envelope. Additionally or instead, the posts (25) can be movable downwardly to engage head portions (27) thereof with the flap portion. The envelopes are then fed in the direction of the hinge edge past an edge member (30) shaped to enter between the envelope flap and body portions and to complete the flap opening movement into alignment with the body portion for reception of insert material at an insert station (9).

10 Claims, 2 Drawing Sheets

35
36
34
30
32
27
11
10
21
5
C
31
B
20
6
7
39

ENVELOPE OPENING MECHANISM FOR INSERTER APPARATUS

The invention relates to an envelope opening mechanism for an inserter apparatus, that is, an apparatus for effecting insertion of desired insert material into each of a series of envelopes.

Such apparatus comprises conveyor means defining a flow path along which envelopes are conveyed successively from a stack or other supply source through an opener station, at which each envelope is opened, to an insert station at which desired insert material, comprising one or more items usually in the form of printed cards or sheets, which may or may not be folded, is placed inside each opened envelope. The filled or loaded envelope is then conveyed from the insert station to be closed, and sealed if required.

Where the insert material is to comprise a plurality of items, a second conveyor means can be provided along which the two or more insert items are assembled into a stack, as by depositing, on each first item, the or each additional item from separate feeder devices, some or all of which can include folding equipment, located along the flow path provided by the second conveyor means. This path ends at the insert station, where each assembled stack is loaded into a respective envelope carried there by the first-mentioned conveyor means.

The envelopes typically comprise panels folded and secured together to form a rectangular pocket or body portion open along one edge at which an integrally formed flap portion is hinged. The flap portion may be generally triangular or rectangular with end edges converging away from the body portion. Initially, the flap portion overlies the body portion, so to enable insert material to be loaded into the body portion, the envelope has to be opened, by turning of the flap portion about the hinge line to a position at which the flap portion extends at least approximately in the plane of the panel of the body portion with which it is integrally formed. The opening mechanism of an inserter apparatus is of course required to operate reliably, and is desirably simple in construction.

The invention accordingly provides an envelope opening mechanism for an inserter apparatus, the mechanism comprising conveyor means for firstly feeding envelopes in succession, with the flap hinges leading, to a first or preliminary opening device which effects a degree of angular separation between the envelope flap and body portions about the hinge line, and for secondly effecting relative movement in the direction of the hinge line of the envelopes, and an edge member engageable with the free edge of the envelope flap, the edge member being shaped to effect further angular movement of the flap and body portions about the hinge line to a relationship permitting insertion of insert material into the envelope body.

Conveniently, the edge member is fixed within the apparatus, and the secondary movement of the envelopes is past the edge member to an insert station at which insert material is fed into the opened envelope in the direction opposite to the first feed direction of the envelopes. With the flap portion upwards and somewhat upwardly inclined, the envelope body then moves beneath the edge member, and the leading edge of the flap portion engages the operative edge of the edge member. The operative edge is advantageously inclined away from the hinge line in the direction of travel at a suitable angle, for example in the range of 45° to 50°, and is curved or otherwise shaped to ensure non-damaging contact with the flap portion edge and smooth sliding along it. As the envelope moves beneath the edge member, the operative edge acts on the flap portion leading edge so as to turn the flap portion to and beyond the upright position, and then at least approximately to a fully opened position.

The edge member is preferably associated with an upstream portion which is inclined to guide the leading edge of the envelope body adjacent the hinge line beneath the edge member. At the downstream end, the edge member is preferably associated with a downturned portion under which the now fully exposed upper or inner surface of the flap portion moves, the downstream panel being shaped and positioned to ensure that the envelope body and flap portions have the desired angular relationship at the insert station.

The first or preliminary opening device serves to effect sufficient angular separation of the envelope flap portion from the body portion for the edge member to complete the opening as described. The first opening device can be of any appropriate kind, but the invention provides two suitable devices, which can be used singly or in combination.

The invention thus provides a preliminary envelope opening device comprising guide means along which envelopes are conveyed in succession with the flap hinge leading to engage the flap hinges with stop or abutment means the guide mean being shaped for slight buckling of the envelope to obtain the desired preliminary opening. The stop or abutment means can thus be located beyond an end edge of the guide means or on a portion thereof inclined in the appropriate direction.

Also in accordance with the invention, there is provided a preliminary envelope opening device comprising conveyor means for delivering an envelope with the hinge line leading to a member operable to engage over the flap portion adjacent the hinge line and to move so as to bend the flap portion and the adjacent part of the envelope body in the direction to open the flap. The second device can readily be combined with the first mentioned device of the invention by arranging for the portion engaging member of the second device to function as the stop or abutment means of the first device.

Either one of these devices, or the two devices in combination, can be incorporated in the inserter apparatus of the invention, the partially opened envelope being conveyed along the direction of the hinge line past the edge member to the insert station, as described.

The invention is further described below, by way of example, with reference to the accompanying drawings, in which.

The inserter apparatus illustrated comprises a frame supporting a work surface over which are moved envelopes, and insert material to be received in them, by conveyor means engaging the envelopes and the insert material. The actuation of the conveyor means, and of other mechanisms of the apparatus to be described, is effected and co-ordinated by appropriate drive arrangements beneath the work surface which are largely conventional and which will accordingly be described only to the extent needed for an understanding of the invention. The inserter apparatus includes, besides the envelope opening mechanism of the invention, other mechanisms necessary to the completion of the insertion operation, but these other mechanisms can be conventional and are accordingly not described in detail.

Figure 1:
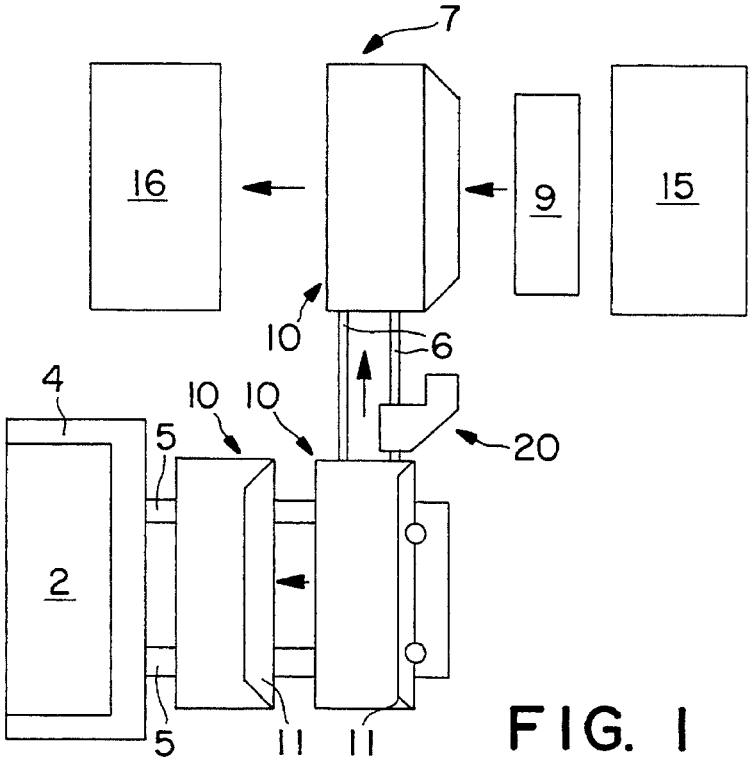
FIG. 1 is a schematic plan view of an inserter apparatus incorporating an envelope opening mechanism in accordance with the invention.

As schematically shown in FIG. 1, the inserter apparatus comprises a hopper 2 or other holder for receiving a vertical stack of envelopes. The lowermost envelope 10 from the stack is fed out from the stack by a separator mechanism 4 and travels on spaced parallel conveyor belts 5 to an opening mechanism 20. The envelopes 10 are positioned on the belts 5 with the flap portion 11 uppermost and at the leading edge of the envelope.

At the mechanism 20 the envelope 10 is first partially opened, at the end of the conveyor path defined by the belts 5. The partially opened envelope is then fed laterally on conveyor belts 6 to an insert station 7 and during this lateral movement further opening of the envelope is effected, so the envelope is fully opened when it arrives at the insert station. Insert material 9, usually in the form of one or more printed sheets, which may or may not be folded, is then fed into the open envelope 10, by a suitable insert mechanism at the station 7, from an insert supply mechanism 15. The insert movement is in a direction opposite to the direction of movement of the conveyor belts 5. The loaded envelope is then moved from the insert station 7, in the same direction, to mechanisms 16 by which the envelope is closed and sealed. When the insert material comprises more than one sheet, the insert supply mechanism 15 can comprise a conveyor extending adjacent to a row of feeders each arranged to feed a single insert sheet onto the track so that a stack of insert sheets is formed progressively along it for insertion at the station 7.

Figure 2:
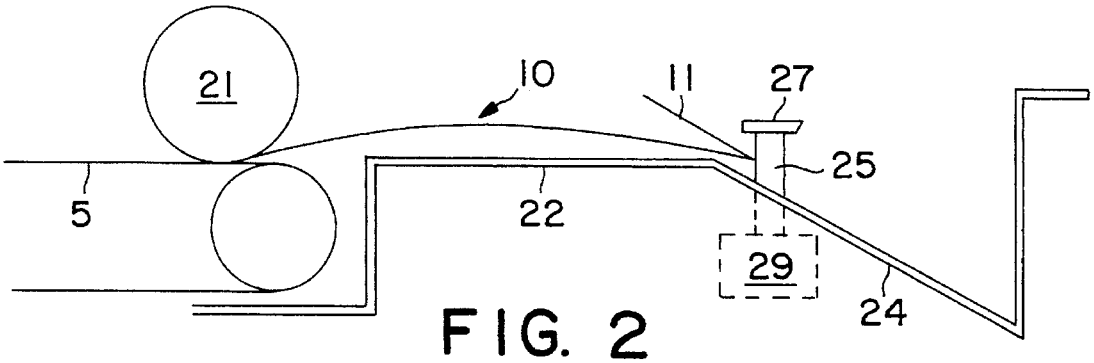
FIG. 2 is a partial schematic side view of the envelope opening mechanism, on a larger scale.
Figure 3:
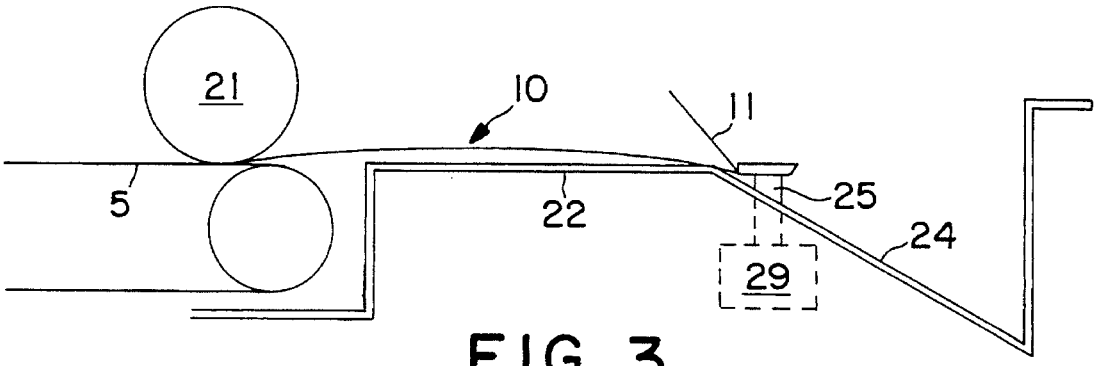
FIG. 3 is a view similar to that of FIG. 2, but in a different position.

Referring now to the envelope opening mechanism 20, this comprises in combination a preliminary envelope opening device, shown in FIGS. 2 and 3, and a further device downstream by which the opening movement is completed during the lateral movement of the envelope to the insertion station The preliminary opening operation begins when the envelope 10 from the separator mechanism 4 is engaged positively with the continuously moving conveyor belts 5 by laterally spaced rollers 21 which are lowered onto the upper surface of the envelope as shown in FIG. 2. The envelope 10 is thus moved off the end of the conveyor belt 5 onto a generally horizontal support surface 22 which extends to a downwardly tilted surface 24. Just beyond the downstream end of the horizontal surface 22, the leading edge of the envelope, corresponding to the hinge line, engages abutment means in the form of a pair of spaced upright posts 25. As will be apparent from FIG. 2, the effect of the drive still being applied to the envelope when it engages against the abutment posts 25 causes the envelope to buckle into an arcuate configuration as seen from the side. Because the support surface 24 slopes downwardly to the abutment posts, the buckling is in the upward direction, which causes the overlying flap portion 11 to turn on the hinge line so as to be angularly spaced from the body of the envelope.

The desired preliminary opening of the envelope has thus been achieved by the time that the envelope has reached the position shown in FIG. 2. The device however provides a two-stage preliminary opening movement, in that it enhances opening by subsequent downward movement of the abutment posts 25 to engage the envelope and effect further opening deformation, as shown in FIG. 3. The abutment posts 25 can take any suitable form which provides for engagement of the upper surface of the flap portion 11, adjacent the hinge line and as shown, the posts are provided with enlarged heads 27 above the position of engagement of the posts by the envelope.

The posts 25 are for this purpose carried for generally vertical movement by a solenoid operated mechanism 29 responsive to the presence of an envelope on the support surface 22, sensed in any suitable way, as by an optical sensor. As the posts are retracted by the mechanism 29, the heads 27 effect a further angular movement of the flap portion 11 relative to the body of the envelope.

The envelope is now in the condition illustrated in the lower righthand corner of FIG. 1, and is ready to be moved by the conveyor belts 6 into the insert station 7. The envelope is fully opened during this movement, to a condition in which the flap is in alignment with the body portion panel of which it is an integral part, or is at an angle thereto which approaches or is greater than 180°, by an edge member 30 best illustrated in FIG. 4A. The edge member 30 is a fixed plate shaped to have functional plate portions as described below.

Figures 4A, 4B, 4C:
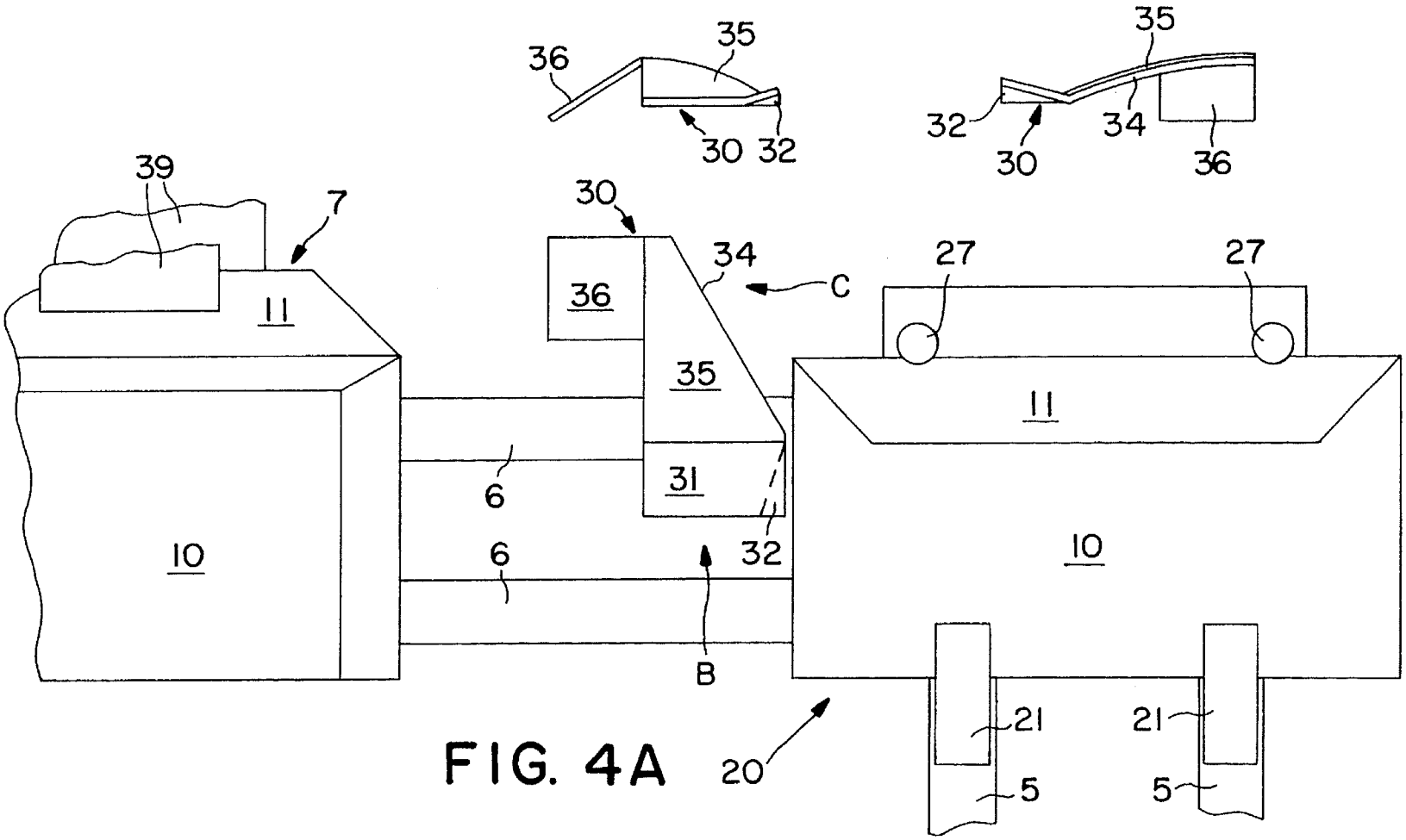
FIG. 4A is an enlarged plan view of the envelope opening mechanism, including an edge member.
FIGS. 4B and 4C are side and end views respectively of the edge member of FIG. 4A only, as viewed in the directions of the arrows B and C respectively of FIG. 4A.

A first rectangular plate portion 31 of the edge member 30 has a shorter edge parallel to and directly adjacent the side edge of the envelope 10 in the position shown in FIG. 3. As the envelope is moved (to the left as shown in FIG. 4A), the envelope body slides beneath the plate portion 31 and to assist correct feeding, the edge region of the plate portion adjacent the envelope is upturned to form a small triangular lead-in portion 32.

The plate portion 31 maintains the envelope 10 on the belts 6 as it advances, and further angular movement of the flap portion 11 is effected by the edge 34 of an adjoining generally triangular curved portion 35 of the edge member. The operative edge 34 extends diagonally away from the direction of movement of the envelope and it also curves upwardly as appears from FIG. 4C.

As the envelope 10 moves beneath the portion 35, the operative edge 34 engages the inclined edge of the flap portion 11 and begins to turn this further into the fully open position. This action continues as the envelope moves, with the flap portion underlying the curved plate portion 35. From the curved portion 35, a downwardly inclined rectangular trailing portion 36 of the edge member extends to act on the flap portion 10 to hold it in its fully open position as the envelope moves into the insert station 7, where the flap portion is retained between two spaced parallel plates 39, over the uppermost of which the insert material 9 is fed into the envelope.

The movement of the partially opened envelope 10 on the continuously running conveyor belts 6 is effected by engagement of rollers (not shown) with the upper surface of the envelope to engage it positively with the belts, in response to the sensing, by any appropriate means, of the absence of an envelope at the insert station 7.

It will be evident that the shape of the edge member 30 need not be precisely as illustrated and described. The curved plate portion can be constituted by a plurality of generally flat portions, but the joins between them should not present substantially discontinuities to avoid any possible damage to the envelope flap portion. The invention can be carried out in a variety of ways other than as specifically described.

What is claimed is:

1. An envelope opening mechanism for envelopes each having a body portion and a flap portion overlying the body portion and hinged thereto along a hinge edge of the envelope, the opening mechanism comprising a first device and a second device, conveyor means (5,6) for moving each envelope (10) firstly to engage said first device (25,27), the first device being arranged to cause buckling of the envelope and consequential initial opening movement of the flap portion relative to the body portion and subsequently to said second device (30), said second device being arranged to effect sufficient opening movement of the flap portion relative to the body portion to permit entry of insert material into the body portion, the conveyor means (5,6) being arranged to move each envelope (10) to engage the first device with the hinge edge leading.

2. A mechanism as claimed in claim 1 wherein the first device comprises abutment means (25) and a support (22, 24) for the envelope upstream of the abutment means, the support having a portion (24) shaped to promote the buckling of the envelope.

3. A mechanism as claimed in claim 2 wherein the support portion (24) provides a support surface for the envelope which is inclined downwardly in the direction of envelope movement towards the abutment means (25).

4. A mechanism as claimed in claim 3 wherein the abutment means (25) has a head portion (27) which overlies the flap portion (11) of the envelope, the abutment means being movable so as to engage the head portion with the flap portion to bend the part of the body adjacent the flap portion towards the downwardly inclined support portion (24).

5. A mechanism as claimed in claim 1 wherein the second device comprises an opening member (30) having a first portion arranged to enter between the flap and body portions (31), a second portion (35) providing an edge (34) engageable with the flap portion to effect progressive opening thereof relative to the body portion and a third portion (36) maintaining the flap portion in the opened position caused by the second portion.

6. A mechanism as claimed in claim 5 wherein the second portion edge (34) is inclined to the direction of relative movement in a direction from the envelope body portion to the flap portion.

7. A mechanism as claimed in claim 5, wherein the second portion edge (34) is curved upwardly away from the envelope body portion and the third portion (36) is inclined downwardly from the second portion (35).

8. An envelope opening mechanism for envelopes each having a body portion and a flap portion overlying the body portion and hinged thereto along a hinge edge of the envelope, the opening mechanism comprising a first device and a second device, conveyor means (5,6) for moving each envelope firstly to said first device (25,27), the first device being arranged to effect an initial opening movement of the flap portion relative to the body portion, and subsequently to said second device, said second device being arranged to effect sufficient opening movement of the flap portion relative to the body portion to permit entry of insert material into the body portion, the conveyor means (5,6) being arranged to move each envelope (10) to the first device (25,27) with the hinge edge leading, and the first device being arranged to engage the flap portion to effect the initial opening movement by causing buckling of the envelope.

9. A mechanism as claimed in claim 8 wherein the first device comprises a member (27) movable to cause the buckling of the envelope adjacent the hinge over an edge between relatively inclined support surfaces (22,24) for the envelope.

10. A mechanism as claimed in claim 8 wherein the movement of the envelope to the second device is substantially in the direction of the hinge edge of the envelope.

* * * * *